US010875697B2

(12) United States Patent
Sandow et al.

(10) Patent No.: US 10,875,697 B2
(45) Date of Patent: Dec. 29, 2020

(54) MATERIAL STORAGE AND TRANSPORT SYSTEM

(71) Applicant: Material Technologies Corporation, New York, NY (US)

(72) Inventors: Adam I. Sandow, Boca Raton, FL (US); Paul Charles Bird, Brooklyn, NY (US); Sarah Smith, New York, NY (US)

(73) Assignee: MATERIAL TECHNOLOGIES CORPORATION, New York, NY (US)

( * ) Notice: Subject to any disclaimer, the term of this patent is extended or adjusted under 35 U.S.C. 154(b) by 0 days.

(21) Appl. No.: 16/144,698

(22) Filed: Sep. 27, 2018

(65) Prior Publication Data

US 2019/0177068 A1 Jun. 13, 2019

Related U.S. Application Data

(60) Provisional application No. 62/563,979, filed on Sep. 27, 2017.

(51) Int. Cl.

| | |
|---|---|
| ***B65D 77/20*** | (2006.01) |
| ***B65D 25/10*** | (2006.01) |
| ***B65D 1/22*** | (2006.01) |
| ***B65D 71/70*** | (2006.01) |
| ***B65D 77/04*** | (2006.01) |
| ***B65D 5/22*** | (2006.01) |
| ***B65D 5/42*** | (2006.01) |

(Continued)

(52) U.S. Cl.

CPC ..... *B65D 77/20* (2013.01); *B65D 1/22* (2013.01); *B65D 5/22* (2013.01); *B65D 5/4266* (2013.01); *B65D 5/5088* (2013.01); *B65D 5/643* (2013.01); *B65D 25/102* (2013.01); *B65D 71/70* (2013.01); *B65D 77/0433* (2013.01)

(58) Field of Classification Search

CPC . B65D 77/20; B65D 1/22; B65D 5/22; B65D 5/4266; B65D 5/5088; B65D 5/643; B65D 25/102; B65D 71/70; B65D 71/0433; B65D 5/68; B65D 55/02; B65D 5/46016; B65D 25/2873

USPC ..... 229/125.02, 125.22, 125.23, 125.32, 229/122.34; 206/499, 216, 461, 775; 220/754; 222/105; D9/737

See application file for complete search history.

(56) References Cited

U.S. PATENT DOCUMENTS 1,322,290 A * 11/1919 Cibulka ..... B65D 5/68 229/125.22

1,856,634 A 5/1932 Hartig (Continued)

*Primary Examiner* — Christopher R Demeree

(74) *Attorney, Agent, or Firm* — Duane Morris LLP; Gregory M. Lefkowitz

(57) ABSTRACT

A material storage and transport system is disclosed. The material storage and transport system can include a material storage tray forming an open-top storage volume defined by a bottom and walls extending up from the bottom along a perimeter of the bottom. The material storage and transport system can also include a releasable strap adapted to extend across the bottom when in a securing configuration and a sample carrier, including at least one sample secured to a sample support substrate by a molded sheet. A lid element and the sample carrier can be adapted (i) to fit within the storage volume when arranged parallel to the bottom, and (ii) to be secured to the material storage tray by the releasable strap.

20 Claims, 10 Drawing Sheets

(51) Int. Cl.
*B65D 5/50* (2006.01)
*B65D 5/64* (2006.01)

(56) References Cited

U.S. PATENT DOCUMENTS

| | | | | | |
|---|---|---|---|---|---|
| 1,922,354 | A | | 8/1933 | Burke | |
| 2,771,237 | A | * | 11/1956 | Philipson | B65D 5/68 229/125.22 |
| 2,822,973 | A | * | 2/1958 | Armstrong | B65D 5/68 229/125.21 |
| 3,991,902 | A | | 11/1976 | Ford, Jr. | |
| 4,067,493 | A | * | 1/1978 | Stavin | B65D 5/46024 206/8 |
| 4,838,425 | A | | 6/1989 | O'Brien et al. | |
| 5,762,191 | A | * | 6/1998 | Etzion | B65D 73/0014 206/278 |
| 9,365,337 | B2 | * | 6/2016 | Fullan | B65D 65/06 |
| 9,631,773 | B2 | * | 4/2017 | Gehlhausen | H01M 2/1094 |
| 2007/0051651 | A1 | | 3/2007 | Marom | |
| 2014/0069059 | A1 | * | 3/2014 | Scott | B65D 55/02 53/416 |

* cited by examiner

MATERIAL STORAGE AND TRANSPORT SYSTEM

CROSS-REFERENCE TO RELATED APPLICATIONS

This application claims priority to U.S. Provisional Application Ser. No. 62/563,979, filed Sep. 27, 2017, the entire contents of which is incorporated herein by reference.

FIELD OF THE INVENTION

The present invention relates to systems for the storage and transport of delicate, three-dimensional materials and objects.

BACKGROUND

A variety of packaging technologies exist for storage and transport of products. These technologies, as well as, the products they package have evolved over time.

SUMMARY

In various embodiments, a material storage and transport system is disclosed. The material storage and transport system can include a material storage tray forming an open-top storage volume defined by a bottom and walls extending up from the bottom along a perimeter of the bottom. The material storage and transport system can also include a releasable strap adapted to extend across the bottom when in a securing configuration and a lid element adapted (i) to fit within the storage volume when arranged parallel to the bottom, and (ii) to be secured to the material storage tray by the releasable strap.

BRIEF DESCRIPTION OF THE FIGURES

The features and advantages of the sample storage and transport device will be more fully disclosed in, or rendered obvious by the following detailed description of the preferred embodiments, which are to be considered together with the accompanying drawings wherein like numbers refer to like parts and further wherein.

DETAILED DESCRIPTION OF THE INVENTION

Figure 1:
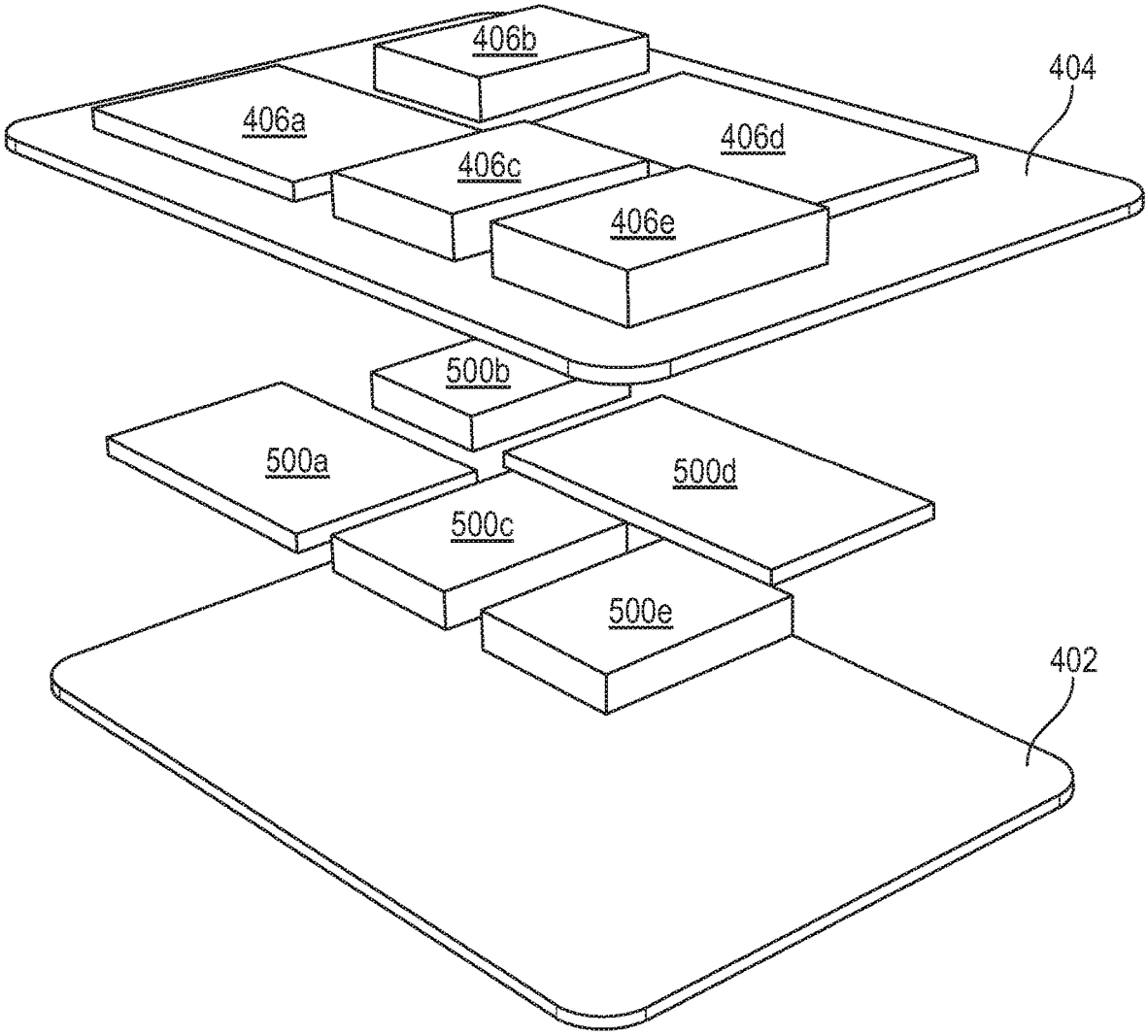
FIG. 1 is an exploded view of a sample carrier as described herein.

The description of the embodiments is intended to be read in connection with the accompanying drawings, which are to be considered part of the entire written description. The drawing figures are not necessarily to scale and certain features of the may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

In various embodiments, as shown in FIGS. 1-10, a material storage and transport system 10 is disclosed. The material storage and transport system 10 can include a material storage tray 100 forming an open-top storage volume 102 defined by a bottom 104 and walls 106 extending up from the bottom 104 along a perimeter 108 of the bottom 104. The material storage and transport system 10 can also include a releasable strap 200 adapted to extend across the bottom 104 when in a securing configuration and a lid element 300 adapted (i) to fit within the storage volume 102 when arranged parallel to the bottom 104, and (ii) to be secured to the material storage tray 100 by the releasable strap 200.

The material storage and transport system 10 can also include a sample carrier 400 that includes at least one sample 500 secured to a sample support substrate 402 by a molded sheet 404. The at least one sample can be a three-dimensional sample, e.g., one that is at least 0.125" in each dimension, or at least 0.25" in each dimension, or at lesat 0.375" in each dimension, or at least 0.5" in each dimension.

Figure 9:
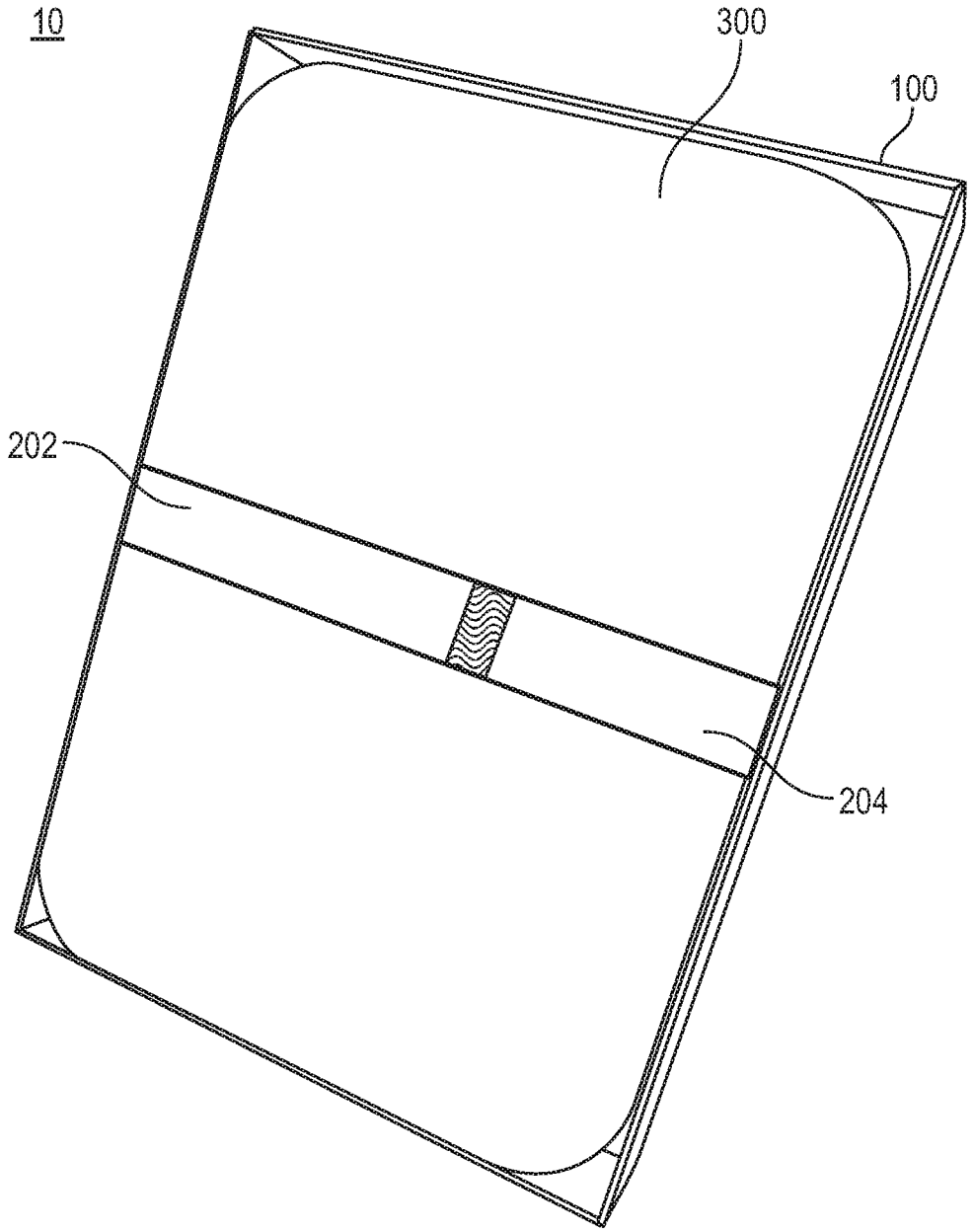
FIG. 9 is a top, perspective view of a complete material storage and transport system with the sample carrier, low-profile materials, and lid element secured by the strap.
Figure 10:
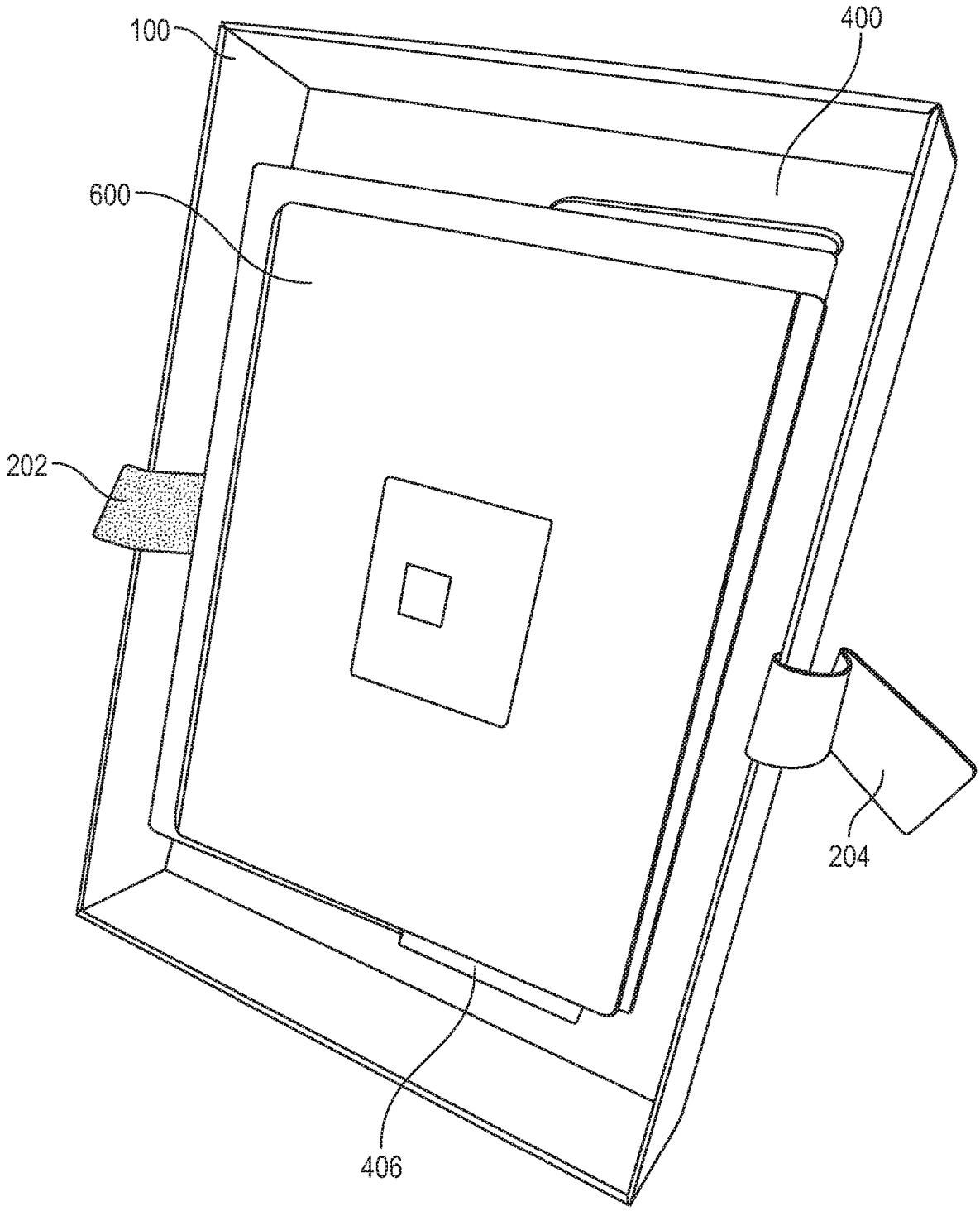
FIG. 10 is a top, perspective view of the material storage and transport system of FIG. 9, with the strap released and the lid element removed to reveal the low-profile materials and sample carrier.

In some embodiments, the molded sheet 404 can include plastic. In some embodiments, the molded sheet 404 can be plastic. In some embodiments, the molded sheet 404 is secured to the sample support 402 substrate by adhesive. In some embodiments, in a securing configuration the sample carrier 400 is adapted (i) to fit within the storage volume 102 when arranged parallel to the bottom 104, and (ii) to be secured to the material storage tray 100 by the releasable strap 200. FIGS. 9 and 10 show examples of a material storage and transport system 10 both in a secured configuration with the lid element (FIG. 9) and in an unsecured configuration with the lid element removed (FIG. 10).

Figure 2:
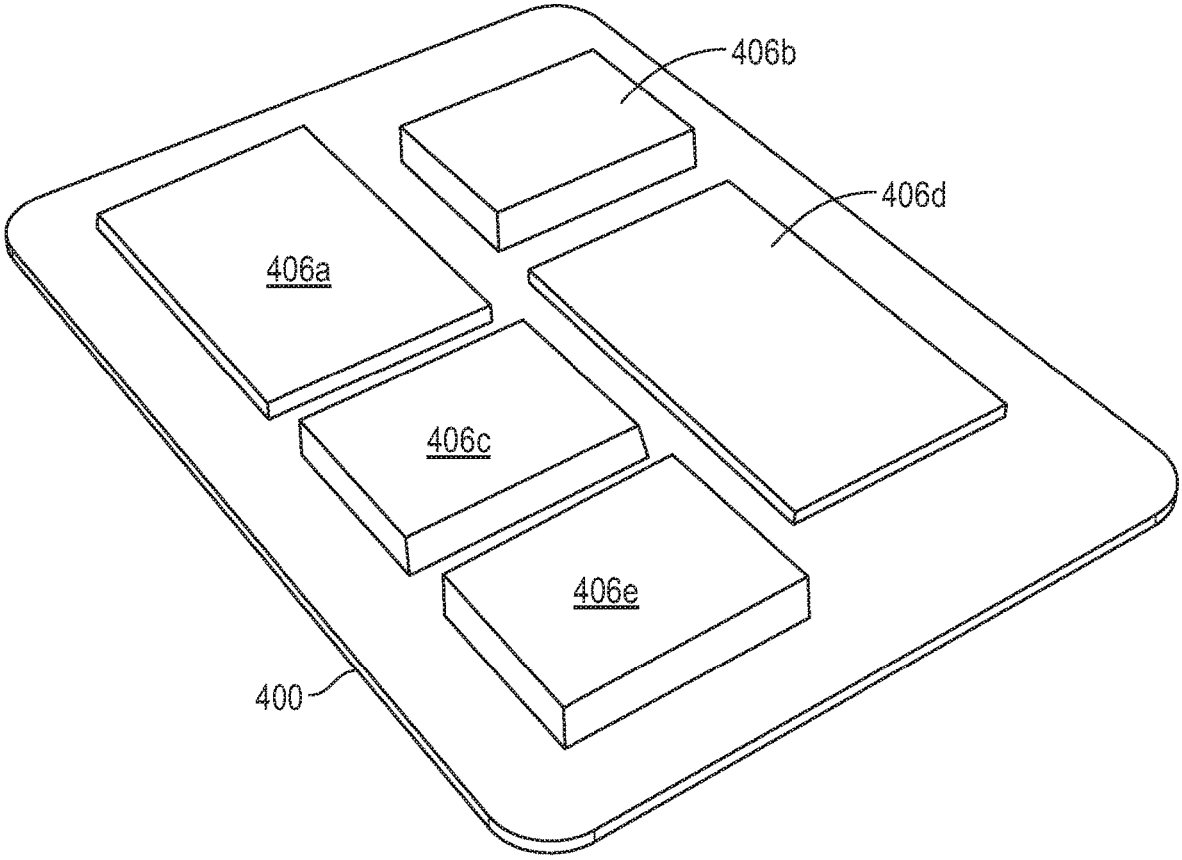
FIG. 2 is perspective view of a sample carrier as described herein.
Figure 3:
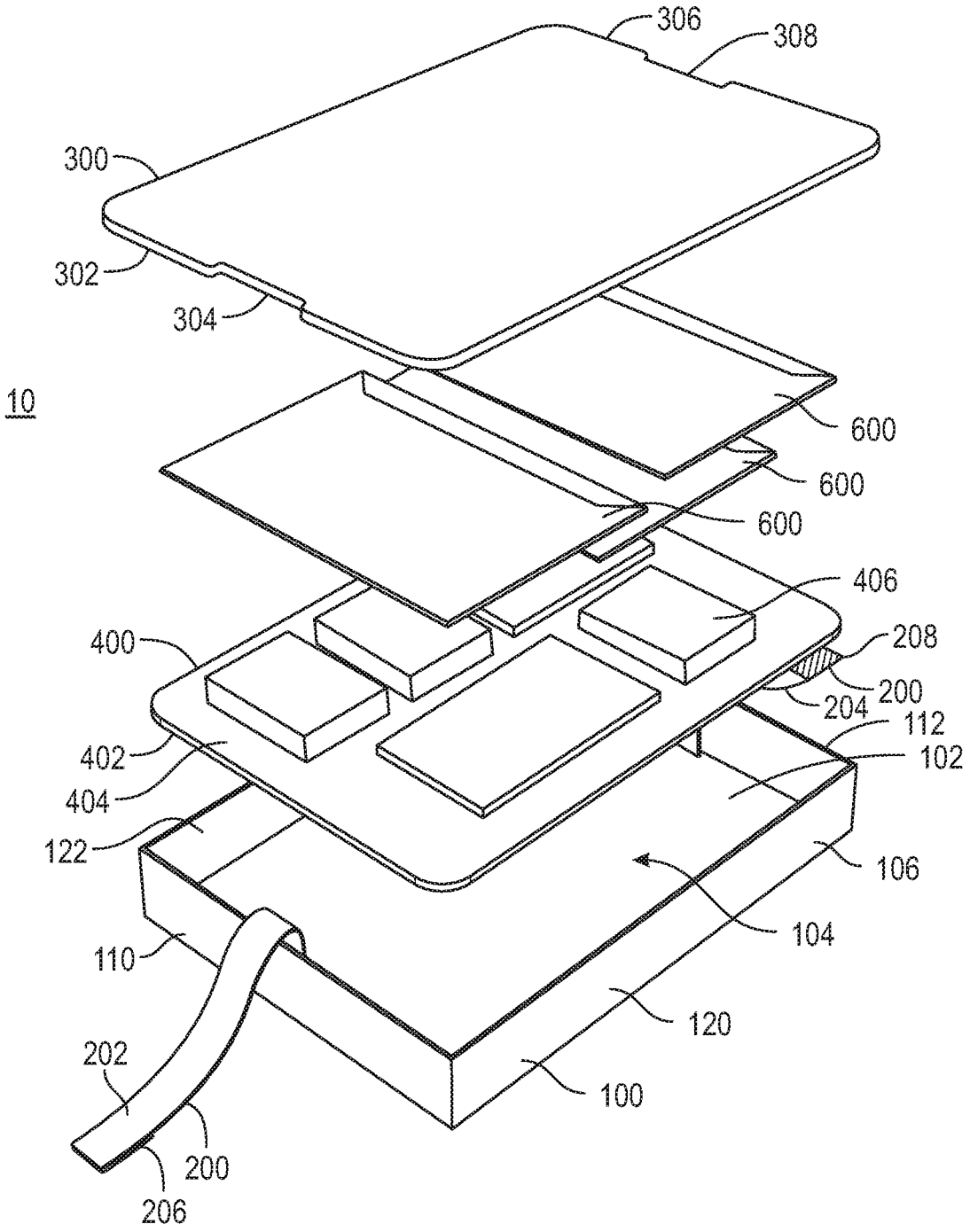
FIG. 3 is an exploded view showing a material storage and transport system as described herein.

In some embodiments, the samples 500 can be placed on the sample support substrate 402, and the molded sheet 404 can be formed by heating a sheet of thermoplastic material 405 then vacuum sealing it to the sample support substrate 402. In some embodiments, as shown in FIGS. 1-3, the samples 500*a*-500*e* can be spaced apart. In some embodiments, the samples 500 are at least 1" from any edges of the sample support substrate 402, or at least 0.75" from any edges of the sample support substrate 402, or at least 0.5" from any edes of the sample support substrate 402. In some embodiments, each samples is at least 0.25" from any adjacent samples, or at least 0.5" from any adjacent samples, or at least 0.75" from any adjacent sample, or at least 1" from any adjacent sample. This allows the molded sheet 404 to form sample storage bubbles 406 that fixedly attaches the samples 500 to the sample support substrate 402 and isolated the samples 500 from one another to minimize damage to the samples 500.

In such embodiments, the sample support substrate 402 can include pores that allow a vacuum to be pulled through the sample support substrate 402 when the heated thermoplastic sheet is brought into contact with the sample support substrate 402. In some embodiments, the thermoplastic sheet 405 is at least 125° F. when it contacts the sample support substrate 402, or at least 150° F. when it contacts the sample support substrate 402, or at least 175° F. when it contacts the sample support substrate 402, or at least 200° F. when it contacts the sample support substrate 402. In some embodiments, the thermoplastic sheet 405 is from 1 mm and 10 mm prior to bonding to the sample support substrate 402, in some embodiments, the thermoplastic sheet 405 is from 2 mm to 9 mm, or from 3 mm to 9 mm, or from 4 mm to 8 mm, or any combination thereof (e.g., from 2 mm to 8 mm).

In some embodiments, these pores are present in order to allow sufficient vacuum to be pulled to form the sample storage bubbles 406 and secure the molded sheet 404 to the sample support substrate 402. In some embodiments, the sample support substrate 402 can be continuously or intermittently coated with a heat activated adhesive to facilitate bonding between the sample support substrate 402 and the molded sheet 404. In some embodiments, the heat activated adhesive is not tacky at room temperature (e.g., <100° F.). In some embodiments, the adhesive can be a thermoplastic resin. In some embodimentes, the adhesive can be an ionically cross-linked thermoplastic based upon ethylene copolymerised with carboxyl groups and a metal ion, such as those sold by DUPONT® under the name SURLYN®

Figure 4:
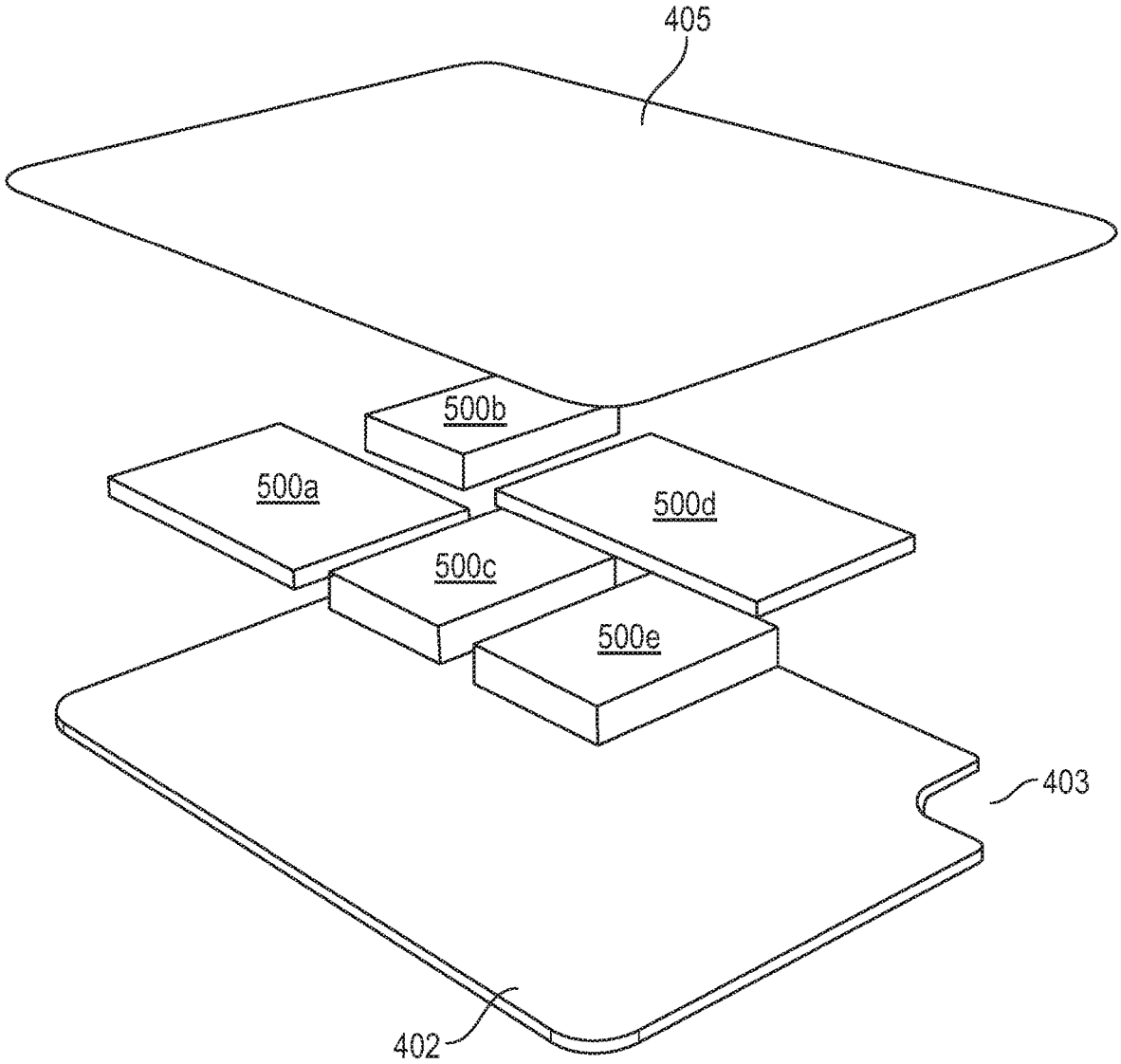
FIG. 4 is an exploded view of a sample carrier as described herein prior to vacuum forming of the thermoplastic sheet.

In some embodiments, the sample support substrate 402 is formed of corrugated cardboard or corrugated plastic. In some embodiments, as shown in FIG. 4, the sample support substrate 402 can include a cut-out 403 so the recipient of the shipment can more easily pull the molded sheet 404 away from the sample support substrate 402 and access the samples. In some embodiments, the cut-out 403 can have a maximum dimension of 1.5" or less (compared to a symmetrical sample support substrate without the cut-out), or 1.25" or less, or 1" or less. In some embodiments, the cut-out 403 can have a maximum dimension of at lest 0.5", or at least 0.75", or at least 1". FIG. 4 shows the thermoplastic sheet 405 prior to vacuum and heat treatment to produce the sample storage bubbles 406, which are evident in FIG. 1.

Using this approach it is possible to produce a sample carrier 400 that is customized for the specific samples 500 placed on the sample support substrate 402. In particular, each of the samples 500*a*-500*e* can be isolated in a discrete sample storage bubble 406. This prevents each sample 500 from moving parallel to the plane of the sample support substrate 502. In some embodiments, the molded sheet 404 can be transparent or translucent so that the samples 500 can be viewed even when they are sealed in the sample carrier 400.

In some embodiments, as shown in FIG. 3, the lid element 300 includes a first lid edge 302 comprising a first strap notch 304 and a second lid edge 306, opposite the first lid edge 302, wherein said second lid edge 306 comprises a second strap notch 308. In some such embodiments, the first strap notch 304 and the second strap notch 308 are adapted for receiving the releasable strap 200 when the lid element 300 is secured to the material storage tray 100 by the releasable strap 200. In some embodiments, the first strap notch 304 can extend over the mid-point of the first lid edge 302, the second strap notch 308 can extend over the mid-point of the second lid edge 306, or both.

In some embodiments, the lid element 300 is formed of a stiff material. In some embodiments, the lid element 300 is formed of corrugated cardboard, corrugated plastic, or wood. In some embodiments, the lid element 300 can be formed of two layers of B-flute cardboard adhered or laminated together.

In some embodiments, as shown in FIG. 3, the material storage and transport system 10 is designed so the sample carrier 400 fits between the bottom 104 and the lid element 300 when the lid element 300 is secured to the material storage tray 100 by the releasable strap 200. In some embodiments, as shown in FIG. 3, the material storage and transport system 10 is designed so the sample carrier 400 and low-profile materials 600 fit between the bottom 104 and the lid element 300 when the lid element 300 is secured to the material storage tray 100 by the releasable strap 200. In some embodiments, the low-profile materials 600 can be one or more envelopes, folders, or other organizers with material samples (e.g., textiles, wall coverings, etc.) stored therein.

The releasable strap 200 can be formed of a fabric, which can be stretchable or non-stretchable. The releasable strap 200 can be adapted to hold the stored elements (e.g., the sample carrier 400 and low-profile materials 600) securely in the material storage and transport system. In particular, the strap prevents the sample carrier 400 from bouncing vertically if the material storage and transport system 10 is dropped or jostled. In combination with the sample storage bubbles 406 and the sample support substrate 402 fitting precisely within the material storage tray 100 (i.e., having the same or nearly the same length and width dimensions as the perimeter 108), this limits movement of the samples 500 within the material storage and transport system 10 in all three orthogonal directions and protects the samples 500 from being damaged during transport.

In some embodiments, as shown in FIGS. 3, 5, 6, and 8-10, the walls 106 comprise a first end wall 110 and a second end wall 112 opposite the first end wall 110. The releasable strap 200 can include a first strap element 202 and a second strap element 204. In some embodiments, as shown in FIG. 3, a proximal portion of the first strap element 202 is attached to the first end wall 110 and a proximal portion of the second strap element 204 is attached to the second end wall 112.

Figure 5:
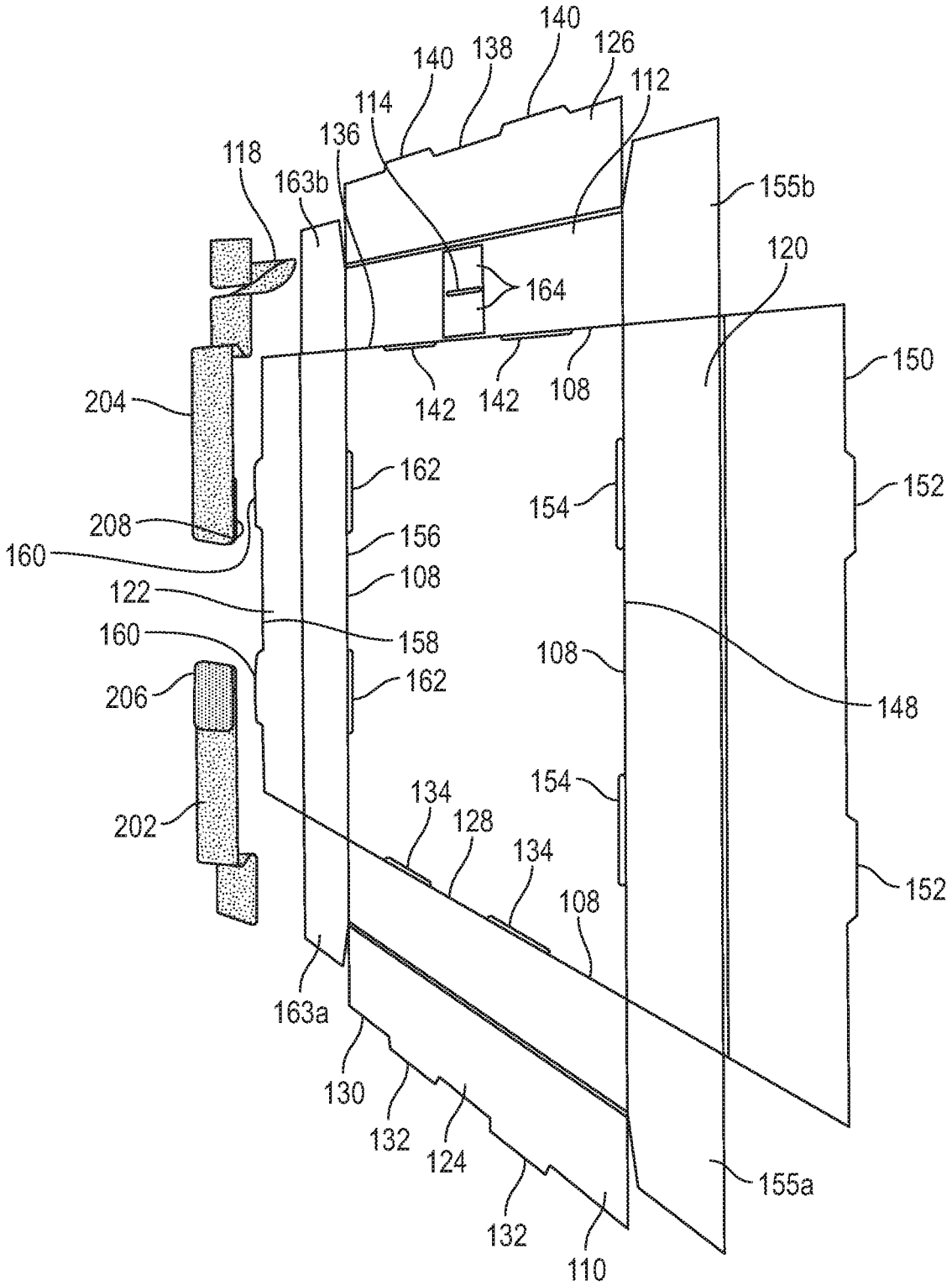
FIG. 5 is an unfolded and exploded view of a material storage tray as described herein.
Figure 6:
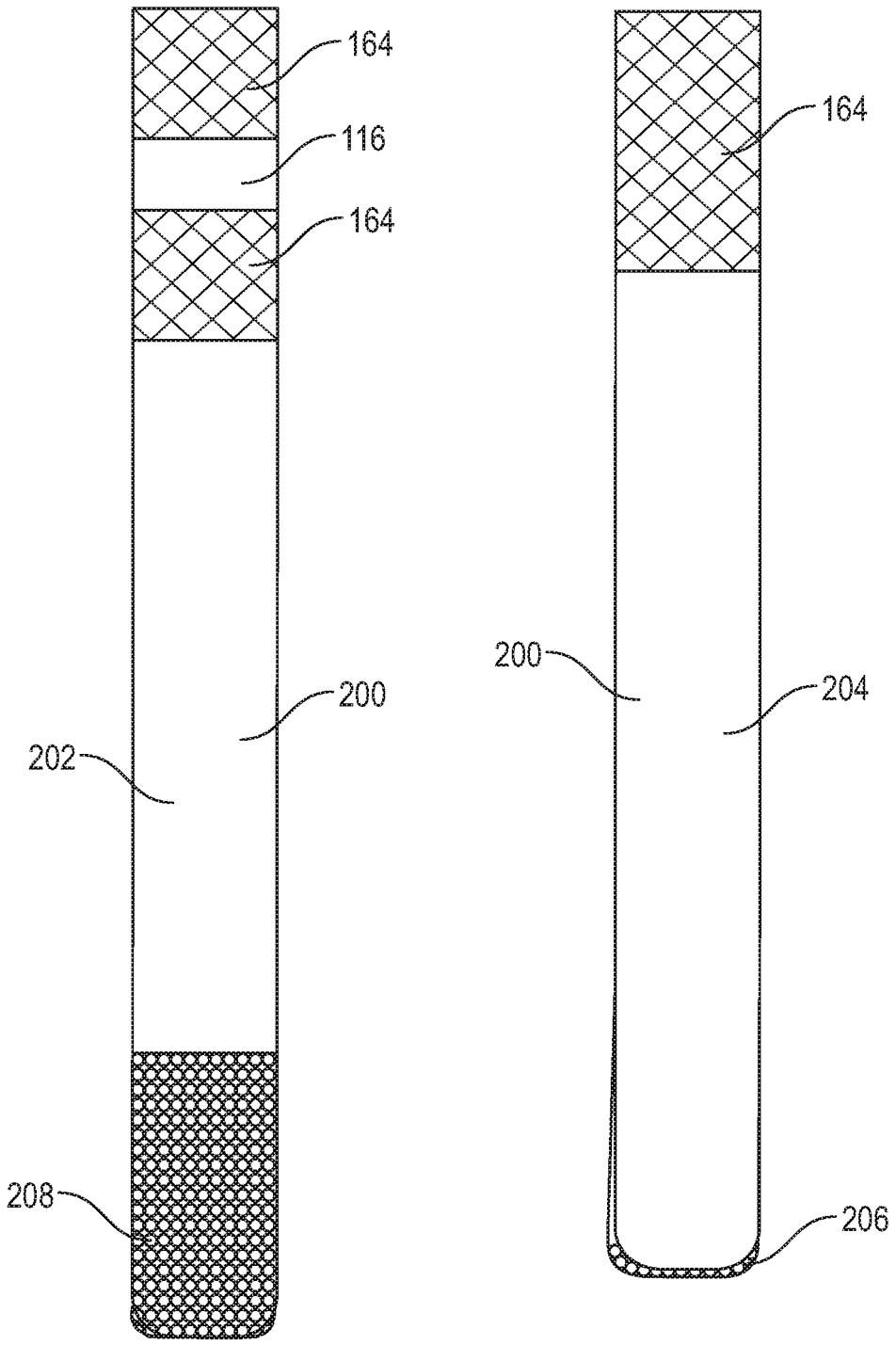
FIG. 6 is a top view of a first and second strap element as described herein.

In some such embodiments, distal portions of the first and second strap elements 202, 204 releasably couple with one another. As shown in FIGS. 5 & 6, in some embodiments, a distal portion of the first strap element 202 includes a hook/loop material 206 and a distal portion of the second strap element 204 includes a corresponding loop/hook material 208 so that the first strap element 202 and the second strap element 204 are releasably coupled.

Figure 7:
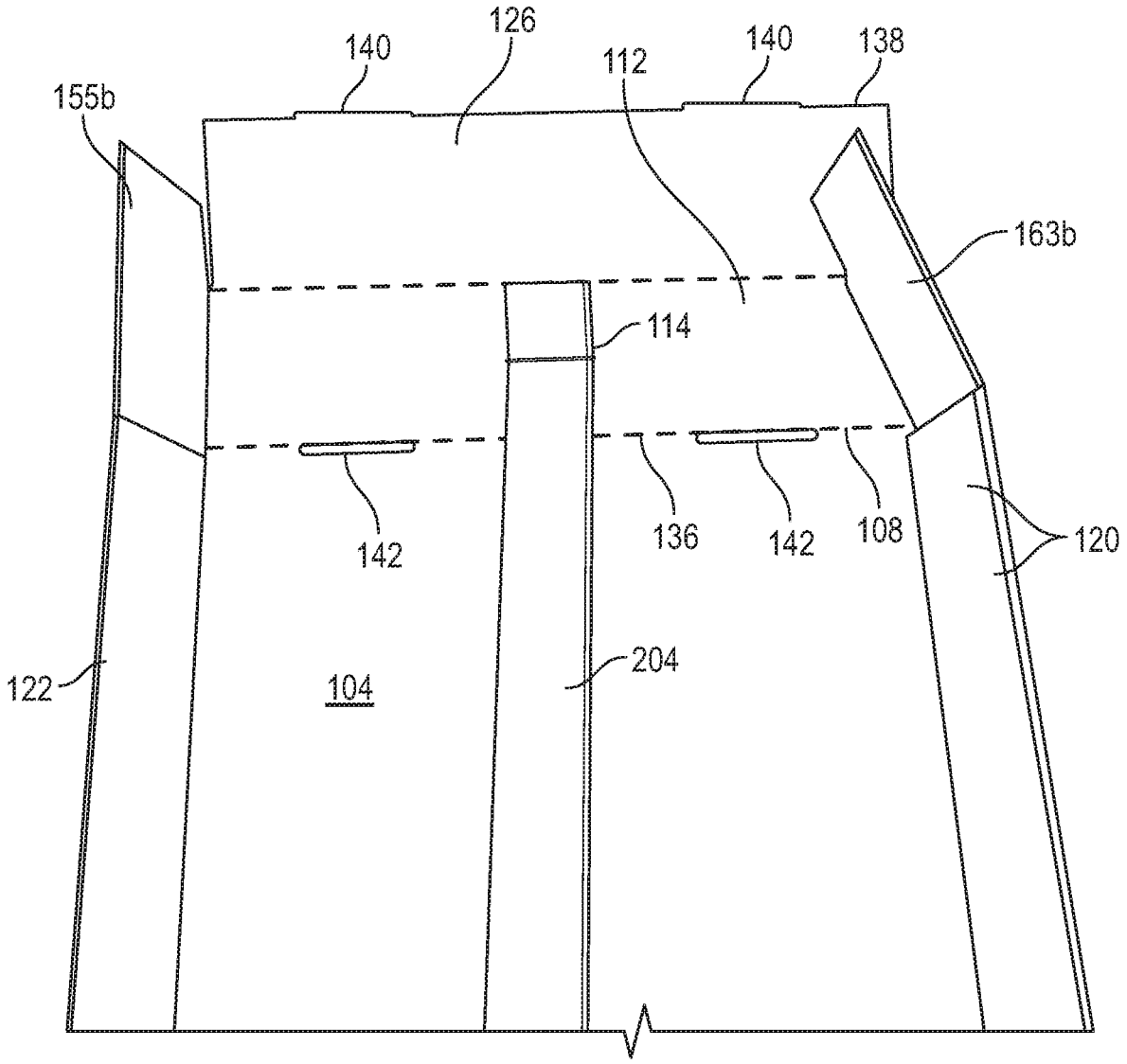
FIG. 7 is a top view of an unfolded second end lip 126 showing how the second strap element is connected thereto as described herein.
Figure 8:
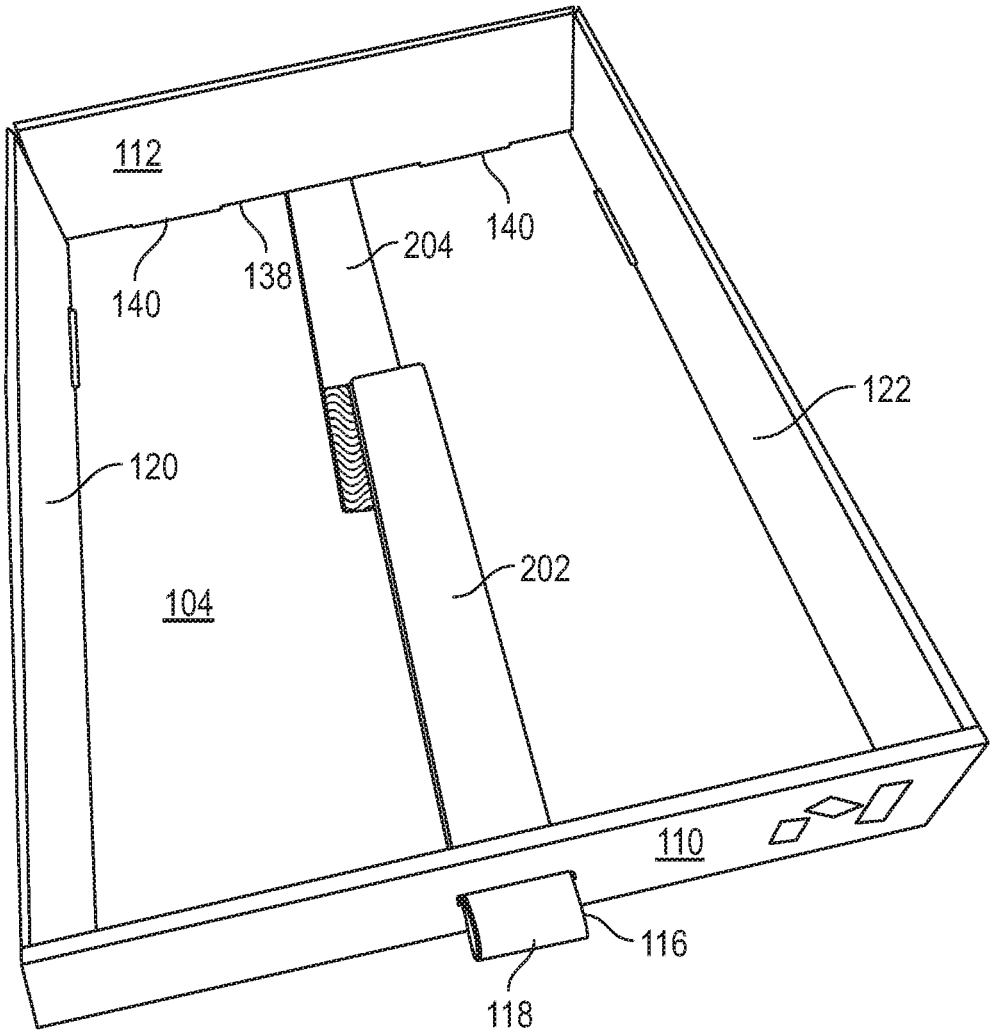
FIG. 8 is a perspective view showing a material storage tray as described herein.

In some embodiments, as shown in FIGS. 5, 7, and 8, the first end wall 110 comprises a pull tab opening 114 and a pull tab 118 extends outside the material storage tray 100 through the pull tab opening 114. In some embodiments, a pull tab strip 116 extends through the pull tab opening 114 to form the pull tab 118. As shown in FIGS. 5, 7, and 8, in some embodiments, the first strap element 202 (e.g., a proximal portion) is the pull tab strip 116.

In some embodiments, as shown in FIGS. 5, 7, and 8, the walls 106 further comprise a first side wall 120 and a second side wall 122 opposite the first side wall 120. In some embodiments, the first side wall 120 comprises the pull tab opening 114 and the pull tab 118 extends outside the material storage tray 110 through the pull tab opening 114. In some such embodiments, the first and second strap elements 202, 204 are attached to the first and second end walls 110, 112, respectively, and the pull tab 118 is formed from a pull tab strip 116 other than the first or second strap element 202, 204. Although the FIGS show the end walls 110, 112 as being shorter than the side walls 120, 122, the end walls 110, 112 and the side walls 120, 122 could be the same length or the end walls 110, 112 could be longer than the side walls 120, 122. In some embodiments, the perimeter 108 has a shape selected from a square, a rectangle, a hexagon, or an octagon.

In some embodiments, as shown in FIG. 8, each strap 202, 204 can extend out from a lower half of the end wall 110, 112 to which it is attcahed. In some embodiments, as shown in FIG. 8, each strap 202, 204 can extend out from a lower third or lower half of the end wall 110, 112 to which it is attached. In some embodiments, when the straps 202, 204 are pulled tight and secured together, the straps 202, 204 contact the bottom 104. In some embodiments, each strap 202, 204 can extend out from under the end wall free edge 130, 138 of the end wall 110, 112 to which it is attached. In some such embodiments, each strap 202, 204 can extend under the end wall free edge 130, 138 between the end wall lip tabs 132, 140.

In some embodiments, as shown in FIGS. 5 and 7, the first end wall 110 is formed by a first end lip 124 and the second end wall 112 is formed by a second end lip 126. In some embodiments, a first end fold line 128 is located between the bottom 104 and the first end lip 124, and a first end free edge 130 includes at least one first end lip tab 132, and at least one first end tab slot 134 is located adjacent to the first end fold line 128. In some embodiments, a second end fold line 136 is located between the bottom 104 and the second end lip 126, and a second end free edge 138 includes at least one second end lip tab 140, and at least one second end tab slot 142 is located adjacent to the second end fold line 136. In some such embodiments, the at least one first end tab slots 134 are adapted for receiving the at least one first end lip tabs 132 when the first end lip 124 is folded up then in half toward the bottom 104, and the at least one second end tab slots 142 are adapted for receiving the at least one second end lip tabs 140 when the second end lip 126 is folded up then in half toward the bottom 104. In such embodiments, the first end fold line 128 and the second end fold line 136 define a portion of the perimeter 108 of the bottom 104.

In some embodiments, as shown in FIGS. 5 and 7, the walls 106 further comprise a first side wall 144 and a second side wall 146 opposite the first side wall 144. In some embodiments, the first side wall 144 is formed by a first side lip 145 and the second side wall 146 is formed by a second side lip 147. In some embodiments, a first side fold line 148 is located between the bottom 104 and the first side lip 145 and a first side free edge 150 includes at least one first side lip tab 152, and at least one first side tab slot 154 is located adjacent to the first side fold line 148. In some embodiments, a second side fold line 156 is located between the bottom 104 and the second side lip 147 and a second side free edge 158 includes at least one second side lip tab 160, and at least one second side tab slot 162 is located adjacent to the second side fold line 156. In some embodiments, the at least one first side tab slots 154 are adapted for receiving the at least one first side lip tabs 152 when the first side lip 1445 is folded up then in half toward the bottom 104, and the at least one second side tab slots 162 are adapted for receiving the at least one second side lip tabs 160 when the second side lip 147 is folded up and in half toward the bottom 104.

In some embodiments, as shown in FIGS. 5 and 7, the first side lip 145 comprises two opposing first side wing tabs 155 extending outward from edges of the first side lip 145, and the second side lip 147 comprises two opposing second side wing tabs 163 extending outward from edges of the second side lip 147. In some such embodiments, one first side wing tab 155*a* and one second side wing tab 163*a* are adapted to fit within a void formed when the at least one first end lip tabs 132 are received by the at least one first end tab slots 134, and the other first side wing tab 155*b* and the other second side wing tab 163*b* are adapted to fit within a void formed when the at least one second end lip tabs 140 are received by the at least one second end tab slots 142.

In some embodiments, the material storage and transport system 10 can be sized to fit snuggly within a sealable box (e.g., a shipping box). As used herein, snuggly refers to having at least two of thickness, width, and length of the material storage tray 10 within 0.5 inches or less than the corresponding interior dimensions of the shipping box, or within 0.25 inches of less than the corresponding interior dimensions of the shipping box.

This provides an added layer protection during shipping and, in combination with the compression strap 200 limits movement of the samples 500 during transport. The pull tab also facilitates removal of the material storage and transport system 10 from the sealable box, once the box has been opened. The walls of the tray can be formed of two layers of E-flute (corrugated) cardboard (one folded back against the other) for durability. These folds create a concealed location for attaching the strap to the walls of the material storage tray. Adhesive 164 attached the straps 202, 204 securely to the box. The pull tab opening 114 allows the strap 200 to extend out of the material storage tray 100 to create a pull tab 128 and be attached to the inside of the wall 106 on both sides of the pull tab opening 114. The thinness of the E-flute cardboard allows us to use a small pull tab opening 114 and receive the pull tab strap 116.

From an aesthetic point, the material storage and transport system is as useful as a display object as it is functional for shipping. Constructing the Sample Tray out of E-flute, allows us to get crisp edges while maintaining stiffness. The user can write on the outside of the walls 106 to indicate what project or type of samples are contained within.

The informational materials 600 can be folders containing two dimensional materials samples such as, but no limited to, textiles, leather, laminates, wallcoverings, window treatments, paints, coatings, as well as, information regarding the materials/samples in the material storage tray. The folders provide an organizational system for these types of samples both in terms of packaging and in the customer's environment. Folders are sized to be compatible with the material storage stray allowing for scalable fulfillment depending on the size of a customer's order. The folders 600 can accommodate all typical two-dimensional sample sizes without folding or creasing.

Although the subject matter has been described in terms of various embodiments, it is not limited thereto. Rather, the appended claims should be construed broadly, to include other variants and embodiments, which may be made by those skilled in the art.

The invention claimed is:

1. A material storage and transport system, comprising:

a material storage tray, forming an open-top storage volume defined by a bottom and walls extending up from the bottom along a perimeter of the bottom;

a releasable strap adapted to extend across the bottom in a securing configuration;

a lid element adapted to (i) fit within the storage volume when arranged parallel to the bottom, and (ii) be secured to the material storage tray by the releasable strap; and a sample carrier, comprising at least one sample secured to a sample support substrate by a molded sheet, wherein the molded sheet is secured to the sample support substrate by adhesive.

2. The material storage and transport system of claim 1, wherein the lid element includes a first lid edge comprising a first strap notch and a second lid edge, opposite the first lid edge, wherein said second lid edge comprises a second strap notch, wherein said first strap notch and said second strap notch are adapted for receiving the releasable strap when the lid element is secured to the material storage tray by the releasable strap.

3. The material storage and transport system of claim 2, wherein said sample carrier is adapted to fit between the bottom and the lid element when the lid element is secured to the material storage tray by the releasable strap.

4. The material storage and transport system of claim 3, wherein the lid element is formed of a corrugated material.

5. The material storage and transport system of claim 1, wherein the lid element includes a first lid edge comprising a first strap notch and a second lid edge, opposite the first lid edge, wherein said second lid edge comprises a second strap notch, wherein said first strap notch and said second strap notch are adapted for receiving the releasable strap when the lid element is secured to the material storage tray by the releasable strap.

6. The material storage and transport system of claim 5, wherein said sample carrier is adapted to fit between the bottom and the lid element when the lid element is secured to the material storage tray by the releasable strap.

7. The material storage and transport system of claim 1, wherein the walls comprise a first end wall and a second end wall opposite the first end wall;

wherein the releasable strap comprises a first strap element and a second strap element;

wherein a proximal portion of the first strap element is attached to the first end wall and a proximal portion of the second strap element is attached to the second end wall, and wherein distal portions of the first and second strap elements releasably couple with one another.

8. The material storage and transport system of claim 7, wherein the first end wall comprises a pull tab opening and a pull tab strip extends through the pull tab opening to form a pull tab outside the material storage tray.

9. The material storage and transport system of claim 7, wherein a portion of the first strap element is the pull tab strip.

10. The material storage and transport system of claim 7, wherein the walls further comprise a first side wall and a second side wall opposite the first side wall, wherein the first side wall comprises a pull tab opening and a pull tab strip extends through the pull tab opening to form a pull tab outside the material storage tray.

11. The material storage and transport system of claim 7, wherein the first end wall is formed by a first end lip and the second end wall is formed by a second end lip;

wherein a first end fold line is located between the bottom and the first end lip and a first end free edge includes at least one first end lip tab, wherein at least one first end tab slot is located adjacent to the first end fold line;

wherein a second end fold line is located between the bottom and the second end lip and a second end free edge includes at least one second end lip tab, wherein at least one second end tab slot is located adjacent to the second end fold line;

wherein the at least one first end tab slots are adapted for receiving the at least one first end lip tabs when the first end lip is folded up then in half toward the bottom; and wherein the at least one second end tab slots are adapted for receiving the at least one second end lip tabs when the second end lip is folded up then in half toward the bottom.

12. The material storage and transport system of claim 11, wherein the walls further comprise a first side wall and a second side wall opposite the first side wall.

13. The material storage and transport system of claim 12, wherein the perimeter has a rectangular shape.

14. The material storage and transport system of claim 12, wherein the first side wall is formed by a first side lip and the second side wall is formed by a second side lip;

wherein a first side fold line is located between the bottom and the first side lip and a first side free edge includes at least one first side lip tab, wherein at least one first side tab slot is located adjacent to the first side fold line;

wherein a second side fold line is located between the bottom and the second side lip and a second side free edge includes at least one second side lip tab, wherein at least one second side tab slot is located adjacent to the second side fold line;

wherein the at least one first side tab slots are adapted for receiving the at least one first side lip tabs when the first side lip is folded up then in half toward the bottom; and wherein the at least one second side tab slots are adapted for receiving the at least one second side lip tabs when the second side lip is folded up then in half toward the bottom.

15. The material storage and transport system of claim 14, wherein the first side lip comprises two opposing first side wing tabs extending outward from edges of the first side lip, and the second side lip comprises two opposing second side wing tabs extending outward from edges of the second side lip;

wherein one first side wing tab and one second side wing tab are adapted to fit within a void formed when the at least one first end lip tabs are received by the at least one first end tab slots; and wherein the other first side wing tab and the other second side wing tab are adapted to fit within a void formed when the at least one second end lip tabs are received by the at least one second end tab slots.

16. The material storage and transport system of claim 12, further comprising a sample carrier, comprising at least one sample secured to a sample support substrate by a molded sheet.

17. The material storage and transport system of claim 16, wherein the lid element includes a first lid edge comprising a first strap notch and a second lid edge, opposite the first lid edge, wherein said second lid edge comprises a second strap notch, wherein said first strap notch and said second strap notch are adapted for receiving the releasable strap when the lid element is secured to the material storage tray by the releasable strap.

18. The material storage and transport system of claim 17, wherein said sample carrier is adapted to fit between the bottom and the lid element when the lid element is secured to the material storage tray by the releasable strap.

19. A material storage and transport system, comprising:

a material storage tray, forming an open-top storage volume defined by a bottom and walls extending up from the bottom along a perimeter of the bottom, wherein the walls comprise a first end wall and a second end wall opposite the first end wall;

a strap that extends across the bottom in a securing configuration, wherein a first portion of the strap is attached to the first end wall and a second portion of the strap is attached to the second end wall; and a sample carrier, comprising at least one sample secured to a sample support substrate by a molded sheet, wherein the molded sheet is secured to the sample support substrate by adhesive, wherein the sample carrier is adapted to (i) fit within the storage volume when arranged parallel to the bottom, and (ii) be releasably secured to the material storage tray by the strap.

20. The material storage and transport system of claim 19, further comprising a lid element adapted to (i) fit within the storage volume when arranged parallel to the bottom, and (ii) be secured to the material storage tray by the releasable strap.

* * * * *